US009890996B2

(12) United States Patent
Hihn et al.

(10) Patent No.: US 9,890,996 B2
(45) Date of Patent: Feb. 13, 2018

(54) SYSTEM FOR TEMPERING VEHICLE BODIES

(75) Inventors: Erwin Hihn, Walddorfhaeslach (DE); Werner Swoboda, Boeblingen (DE); Tatjan Urich, Stuttgart (DE)

(73) Assignee: EISENMANN SE, Boeblingen (DE)

( * ) Notice: Subject to any disclaimer, the term of this patent is extended or adjusted under 35 U.S.C. 154(b) by 335 days.

(21) Appl. No.: 14/000,656

(22) PCT Filed: Feb. 7, 2012

(86) PCT No.: PCT/EP2012/000536

§ 371 (c)(1),
(2), (4) Date: Oct. 2, 2013

(87) PCT Pub. No.: WO2012/113507

PCT Pub. Date: Aug. 30, 2012

(65) Prior Publication Data

US 2014/0020258 A1 Jan. 23, 2014

(30) Foreign Application Priority Data

Feb. 21, 2011 (DE) ..... 10 2011 011 898

(51) Int. Cl.
*F26B 21/00* (2006.01)
*F26B 15/12* (2006.01)

(52) U.S. Cl.
CPC ..... *F26B 21/00* (2013.01); *F26B 15/12* (2013.01); *F26B 21/004* (2013.01); *F26B 21/006* (2013.01); *F26B 2210/12* (2013.01)

(58) Field of Classification Search
CPC ..... F26B 15/12; F26B 21/00; F26B 21/004; F26B 21/006; F26B 2210/12
See application file for complete search history.

(56) References Cited

U.S. PATENT DOCUMENTS

| | | | | |
|---|---|---|---|---|
| 2,416,759 | A | 3/1947 | Lathrop | |
| 4,771,552 | A | 9/1988 | Morioka | |
| 5,456,023 | A | 10/1995 | Farnan | |
| 6,176,775 | B1 * | 1/2001 | Volk | B60H 1/3414 454/154 |
| 7,200,953 | B2 | 4/2007 | Sonner et al. | |
| 2002/0162245 | A1 * | 11/2002 | McElroy | B60S 3/002 34/666 |
| 2003/0163932 | A1 * | 9/2003 | Samekawa | B05D 7/14 34/666 |
| 2011/0126378 | A1 * | 6/2011 | Ota | B08B 5/02 15/405 |

FOREIGN PATENT DOCUMENTS

| | | |
|---|---|---|
| DE | 201 04 205 | 7/2001 |
| GB | 346 432 | 4/1931 |

* cited by examiner

*Primary Examiner* — Jessica Yuen

(57) ABSTRACT

A system for tempering vehicle bodies having a housing, a tempering tunnel in the housing, at least one pressure chamber in a housing and separated by a wall from the tempering tunnel, a plurality of nozzles in the wall and an air tempering unit which introduces tempered air into the pressure chamber in such a way that the tempered air flows in through the nozzles into the tempering tunnel and acts on the vehicle body. At least one nozzle unit is oriented and has a range that is wide enough, such that the air stream exiting the nozzle unit passes through an opening in the vehicle body on the side facing the nozzle unit and acts on an inner face of the vehicle body on the opposite side.

20 Claims, 9 Drawing Sheets

SYSTEM FOR TEMPERING VEHICLE BODIES

RELATED APPLICATIONS

This application claims the filing benefit of International Patent Application No. PCT/EP2012/000536, filed Feb. 7, 2012, which claims the filing benefit of German Patent Application No. 10 2011 011 898.5 filed Feb. 21, 2011, the contents of both of which are incorporated herein by reference.

FIELD OF THE INVENTION

The invention relates to a device for tempering motor vehicle bodies, in particular for drying coated motor vehicle bodies, having a) a housing;
b) a tempering tunnel accommodated in the housing for receiving the motor vehicle body;
c) at least one pressure chamber accommodated in the housing and separated from the tempering tunnel by a wall;
d) a plurality of nozzles in the wall;
e) an air tempering unit, which introduces tempered air into the pressure chamber in such a manner that it is able to flow through the nozzles into the tempering tunnel and act upon the motor vehicle body therein.

BACKGROUND OF THE INVENTION

"Motor vehicle body" is here understood as meaning not only the complete motor vehicle body but also those large parts of such a body in which the problems described below occur in the same manner.

When the "tempering" of a motor vehicle body is mentioned herein, it is intended to mean the bringing about of a specific temperature of the motor vehicle body that it initially does not possess. It can be a temperature increase or a temperature reduction. "Tempered air" is understood as being air that has the temperature required for the tempering of the motor vehicle body.

A case of the tempering, namely the heating, of motor vehicle bodies that occurs frequently in the automotive industry is the operation of drying the coating of a motor vehicle body, whether the coating be a paint or an adhesive or the like. The following detailed description of the invention is given using the example of such a drier.

When "drying" is mentioned herein, it is intended to mean any operation in which the coating of a motor vehicle body, in particular a paint, can be made to cure, either by expelling solvents or by crosslinking the coating substance.

Known devices of the type mentioned at the beginning that are configured as driers conventionally possess a pressure chamber on both sides of the tempering tunnel, which in this case is referred to as the drying tunnel. The nozzles, which are accommodated in the walls separating the pressure chambers from the drying tunnel, normally have the same construction, in particular the same projection distance, and differ at most in their orientation, that is to say in the direction of projection; this is chosen in each case so that it is aimed at specific surface regions of the motor vehicle body that is to be dried. All the nozzles in effect act only upon the outer surface of the motor vehicle body. If the air streams emerging therefrom also pass through openings into the inside of the motor vehicle body, they have no appreciable effect there owing to their short reach, especially since two such nozzles generally face one another with opposing flow directions and thus mutually compensate for the action in the interior.

Motor vehicle bodies have recently become increasingly more complex in their construction. In particular, they have different masses in different regions. For example, the lowermost region, the sill region or the floor assembly, has a high mass and consequently possesses a considerable heat capacity. Heating of the different regions of the motor vehicle body that is carried out from only one side requires a not inconsiderable time until the heat has penetrated those regions completely. In addition, that time differs locally according to the mass distribution and the distribution of the heat capacities in the region in question. The dwell time of the motor vehicle body that is to be dried in the drier must therefore be adapted to the longest time that is required for drying of the region of the motor vehicle body that is least favourable and has the greatest mass. Not only are the cycle times of the drier increased as a result; overheating can additionally occur in those regions of the motor vehicle body that dry more quickly. This can be particularly disadvantageous where different materials, including heat-sensitive materials, have been used in the motor vehicle body and/or adhesive bonds have been produced.

An object of the present invention is to configure a device of the type mentioned at the beginning in such a manner that shorter cycle times can be achieved.

SUMMARY OF THE INVENTION

The object may be achieved according to the invention in that f) there is provided at least one nozzle unit which is so oriented and the distance of projection of which is so great that the air stream leaving it is able to pass through an opening in the motor vehicle body on the side facing the nozzle unit and act upon the inner surface of the motor vehicle on the opposite side.

According to the invention, therefore, the concept hitherto applied throughout of exposing the motor vehicle body to tempered air from only one side, namely from the outside, is abandoned. Instead, a tempered air stream is purposively produced by at least one nozzle unit, which air stream passes through an opening on the side of the motor vehicle body facing the nozzle unit and then acts upon the inner surface of the opposite wall of the motor vehicle body. This can also take place from opposite sides of the motor vehicle body. In this manner, tempering of the motor vehicle body takes place both from outside and from inside, which is naturally accompanied by a significant shortening of the tempering time.

In a particularly preferred embodiment of the invention, at least one nozzle unit has movable air guiding elements, so that the direction of projection of the nozzle unit is adjustable.

Motor vehicle bodies of different geometries and constructions can be guided through such a device; the tempering action can be adapted to the specific construction by adjusting the direction of projection of the nozzle unit. In the case where the system is operated by type, that is to say where motor vehicle bodies of the same type are always dried, adjustment of the air guiding elements can take place manually.

It is particularly advantageous if the air guiding elements are movable by means of a motor. No manual intervention is then required to adjust the air guiding elements. The type of motor vehicle body being treated in a particular case can be detected automatically, and the position of the air guiding elements can be adjusted automatically in the required manner by a corresponding control device. In this manner it is also possible to move the air guiding elements continuously with the motor vehicle body in such a manner that the tempered air stream leaving the corresponding nozzle unit follows the motor vehicle body as it passes through the tempering tunnel. Longer times for exposure of a particular location on the motor vehicle body can thus be achieved without lengthening the cycle time.

It is also possible for the air guiding elements to be movable by a carrier device, which cooperates with a part that is moved together with the motor vehicle body in such a manner that the direction of projection of the nozzle unit follows the motor vehicle body over a certain distance as it moves through the tempering tunnel. In this embodiment, therefore, motor-operated drive elements are not required for the air guiding elements, and sensors that monitor the position and movement of the motor vehicle body, and corresponding control devices, are not required.

The embodiment of the drier according to the invention in which the nozzle unit has air guiding elements that are pivotable about two mutually perpendicular axes is particularly variable.

The nozzle unit can be removably fixed in at least one opening in the wall between the pressure chamber and the tempering tunnel. In this manner, it can quickly be removed if required, so that it does not interfere with particular work such as cleaning and maintenance, also of the transport system, outside of the actual tempering operation.

It is also advantageous if the at least one opening in which the nozzle unit is fixed is configured in the same manner as the openings in which the other, normal nozzles are fixed in the same wall. The nozzle unit can accordingly be retrofitted, for example, to a conventional device by removing one or more of the normal nozzles from the wall between the pressure chamber and the tempering tunnel and instead fixing in that or those openings the nozzle unit according to the invention. Conversely, the removal of a device configured according to the invention from a conventional device is, of course, also possible without difficulty.

It is to be understood that the aspects and objects of the present invention described above may be combinable and that other advantages and aspects of the present invention will become apparent upon reading the following, description of the drawings and detailed description of the invention.

BRIEF DESCRIPTION OF THE DRAWINGS

Exemplary embodiments of the invention will be explained in detail below by means of the drawing, in which.

DETAILED DESCRIPTION OF THE PRESENT INVENTION

Figure 1:
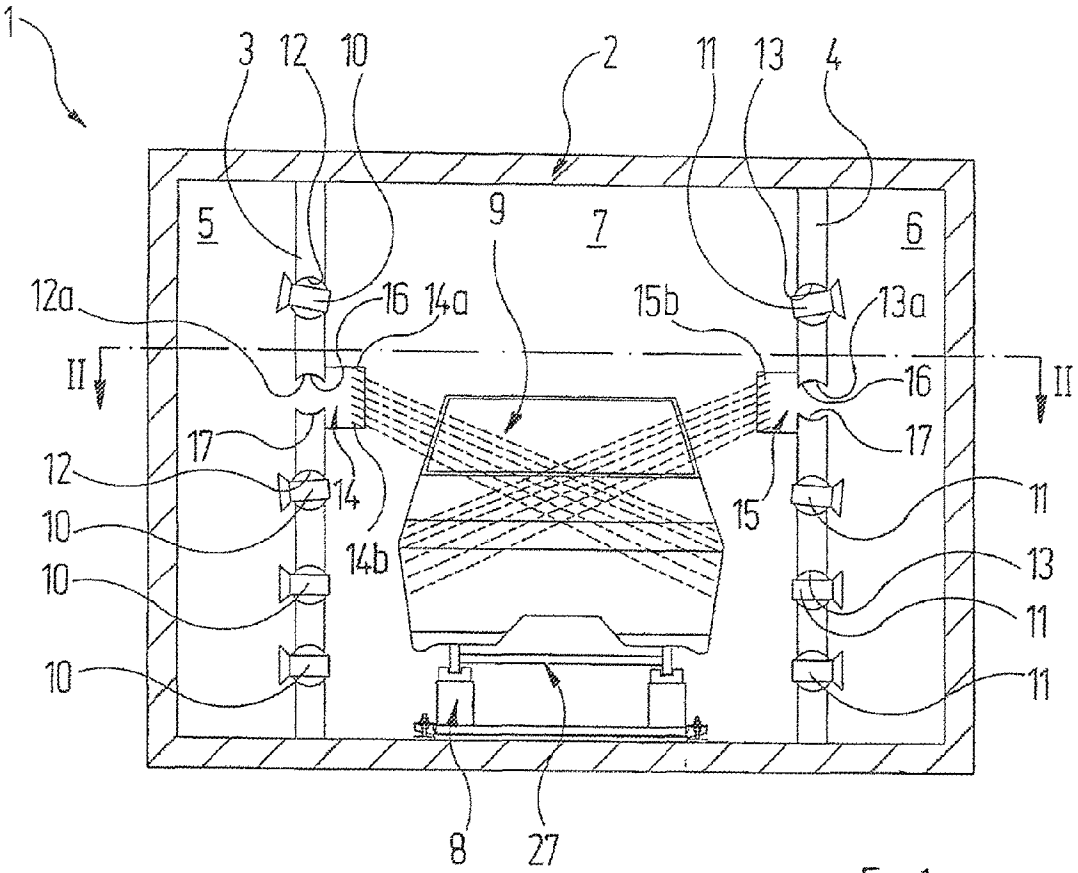
FIG. 1 shows a vertical section through a drier for drying coated motor vehicle bodies.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
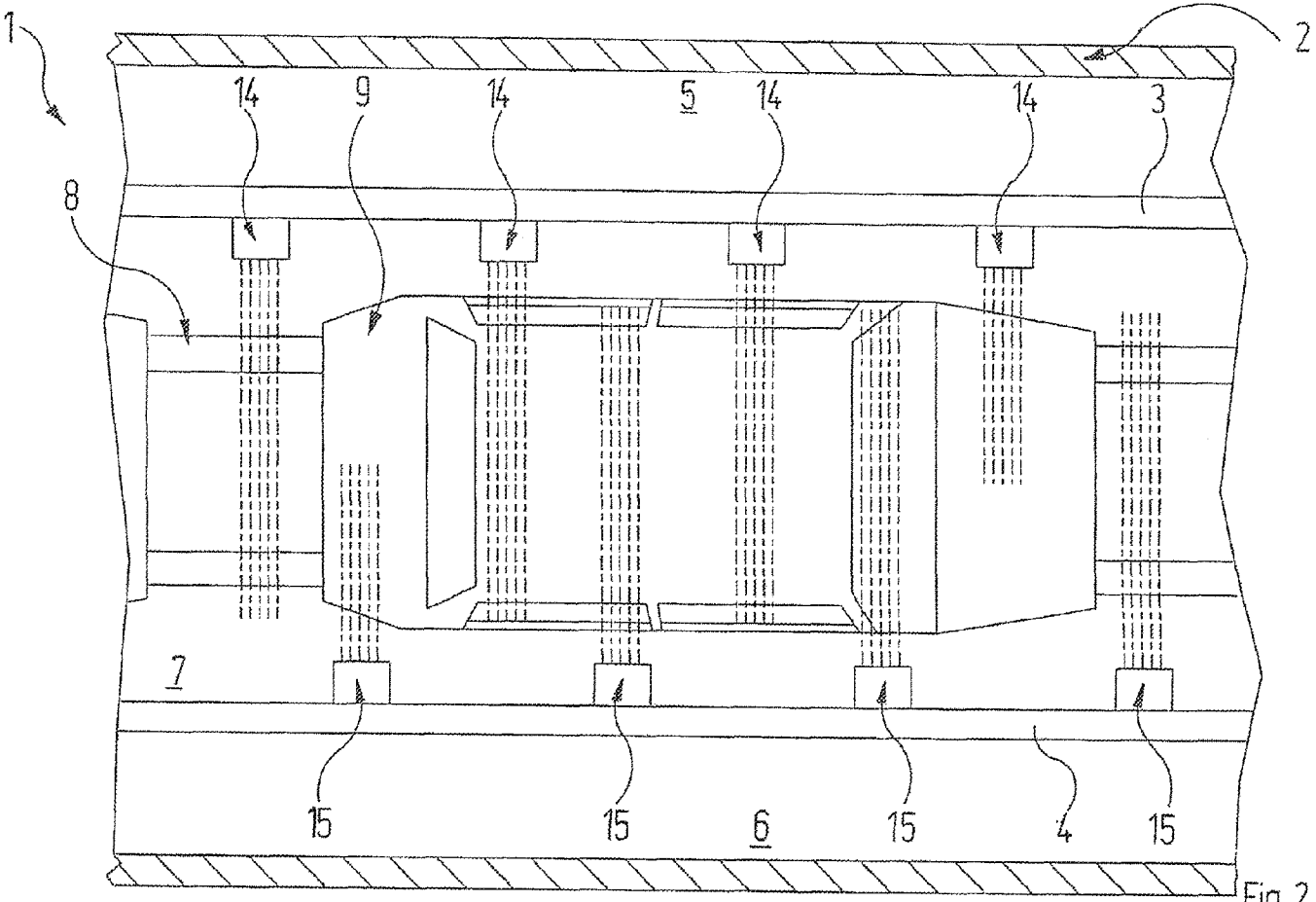
FIG. 2 shows a horizontal section through the drier of FIG. 1 according to line II-II therein.

Reference will first be made to FIGS. 1 and 2. The drier shown here, which is designated generally by the reference numeral 1, has in known manner a housing 2, the interior of which is divided by two vertical longitudinal walls 3, 4 into two lateral pressure chambers 5, 6 and a middle drying tunnel 7. The motor vehicle bodies 9 to be coated are conveyed through the drying tunnel 7 perpendicular to the plane of the drawing of FIG. 1 by means of a transport system 8, which is shown schematically. At the ends of the drying tunnel 7 there are generally provided locks (not shown), which allow the motor vehicle body 9 to pass into and out of the drying tunnel 7 without great heat loss and with a low atmosphere exchange.

In the two walls 3, 4 there is a plurality of nozzles 10, 11, which establish a connection between the pressure chambers 5 and 6 and the drying tunnel 7. The nozzles provided with reference numerals 10 and 11 are of conventional configuration; their direction of projection is adjustable and their direction of projection is so short that they are able to act upon the side of the motor vehicle body 9 facing them. The nozzles 10, 11 are located in openings 13, 14 with spherical-cap-shaped delimiting walls, as a result of which the nozzles 10, 11 are guided in an adjustable manner in their angular position.

In each of the openings 12*a* and 13*a* in the walls 3, 4 that is located in the position second from the top there is no conventional nozzle 10 or 11. Instead, a special nozzle unit 14 or 15 is fixed therein, which nozzle unit is provided for that purpose with two spherical-cap-shaped clamping plates 16 and 17. The arrangement is accordingly such that the nozzle units 14, 15 can be mounted in the corresponding wall 3, 4 in place of a conventional nozzle 10, 11. In this manner, conversion of a conventional drier into a drier 1 according to the invention and vice versa is possible.

The nozzle units 14, 15 are identical in construction, so that it is sufficient to describe the nozzle opening 14. This comprises a box-like housing 14*a*, which is substantially open on the side facing the motor vehicle body 9 and is provided on its rear side, which abuts the wall 3, with an opening that communicates via the corresponding opening 12*a* with the pressure chamber 5. Inside the housing 14*a* there are parallel fins 14*b* as air guiding elements, which in the exemplary embodiment shown in FIGS. 1 and 2 are built fixedly into the housing 14*a*, that is to say are not movable.

The particular feature of the nozzle units 14, 15 is that, unlike the "normal" nozzles 10, 11, they are in the form of long-range nozzles. In this manner it is possible in the manner shown in FIGS. 1 and 2 to direct the hot air leaving the nozzle units 14, 15, the circulation of which in the drier 1 will be described in detail below, through an opening in the side face of the motor vehicle body 9 that is facing them, for example through a window opening or through an open door, onto the inner surface of the opposite side of the body, so that the hot air stream thus passes through the whole of the interior of the motor vehicle body 9. The direction of this hot air is such that it is directed predominantly at the bottom, inner region of the motor vehicle body 9, where there is a comparatively great mass and therefore a large heat capacity.

The pressure chambers 5, 6 are fed in known manner with hot air, which then passes not only in the manner already indicated above through the nozzle units 14, 15 but also through the normal nozzles 10, 11, so that hot air acts upon the outsides of the motor vehicle body through the normal nozzles 10, 11 and upon the insides of the motor vehicle body 9 through the additional nozzle units 14, 15. In this manner it is possible to dry all regions of the motor vehicle body 9 in approximately the same time, even though they are "high-mass" to differing degrees and therefore have different heat capacities. As a result, the total drying time of the motor vehicle body 9 can be shortened; local overheating, which could damage the materials of the motor vehicle body 9 or bonds located thereon, does not occur.

As mentioned above, the nozzle units 14, 15 of the exemplary embodiment of FIGS. 1 and 2 are fixed, so that the direction of the hot air stream leaving them is not adjustable. It may, however, be advantageous for that direction to be adjustable, as is shown by means of FIGS. 3*a* to 3*c* for a modified drier 101. Where components shown in FIG. 3 correspond to those of FIGS. 1 and 2, they are identified by the same reference numerals plus 100.

Figure 3:
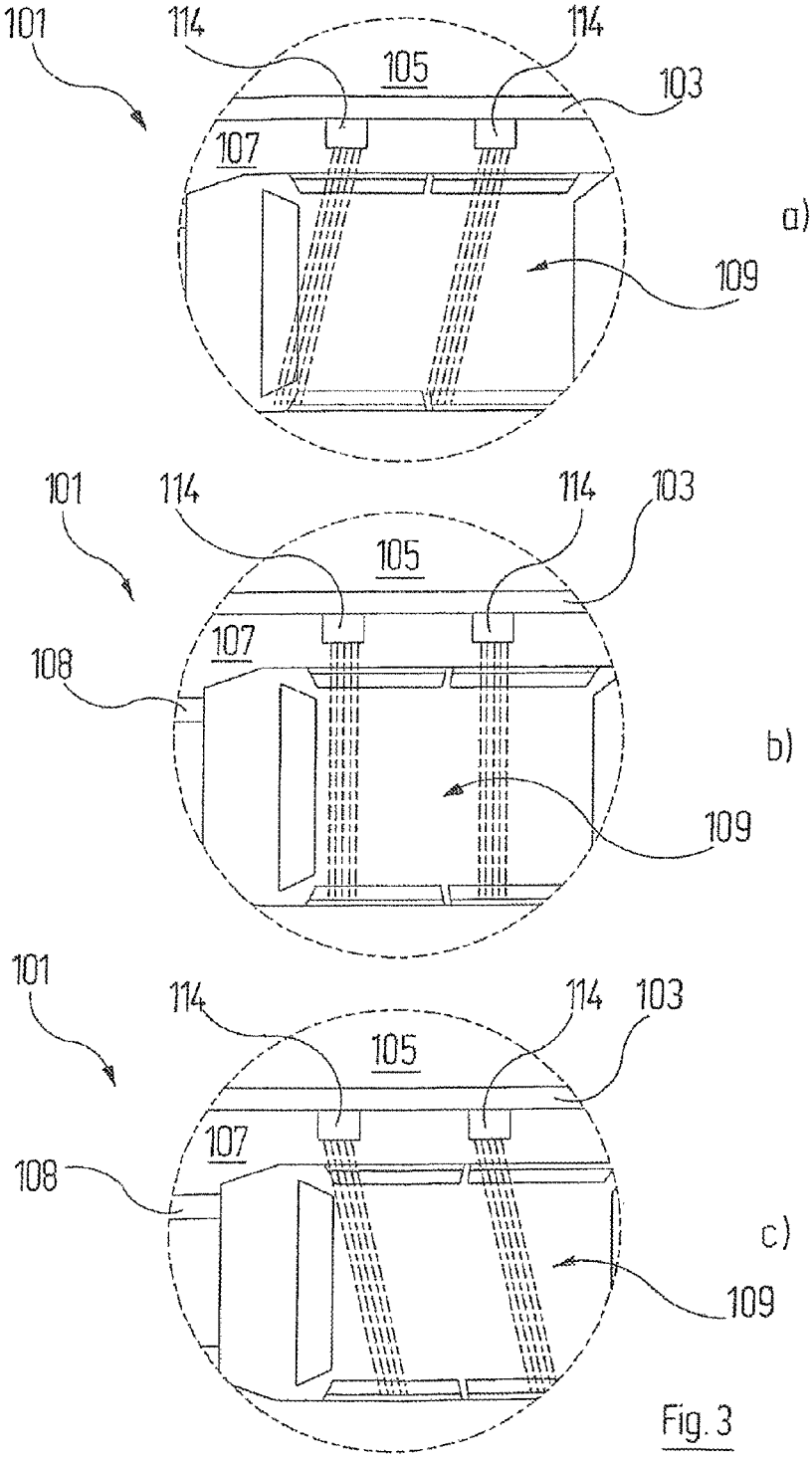
FIG. 3 shows horizontal sections, similar to FIG. 2, through part of the drier with different nozzle positions.

FIGS. 3*a* to 3*c* are horizontal sections through the modified drier 101, similar to FIG. 2, but each show only a cutout. There can be seen a pressure chamber 105, the wall 103 which separates the pressure chamber 105 from the drier tunnel 107, the coated motor vehicle body 109 that is to be dried, and two nozzle units 114. While the fins 14*b* and 15*b* in the nozzle units 14, 15 of FIGS. 1 and 2 were fixed, in the exemplary embodiment of FIG. 3 they are pivotable about a vertical axis, but their parallel orientation is retained. The mechanism required therefor is not shown but is known to the person skilled in the art.

Partial figures a to c of FIG. 3 show how the directions of projection of the nozzle units 114 follow the movement of the motor vehicle body 109. The direction of movement of the motor vehicle body 109 is from left to right. It will be seen how the hot air streams leaving the nozzle units 114 follow the movement of the motor vehicle body 109 and are thus able to act upon the inner surfaces of its side walls for longer than in the case of rigidly oriented fins. FIG. 3 shows only the nozzle units 114 on one side of the drying tunnel 107; the opposite nozzle units (not shown) are, of course, configured in the same way.

Figure 4:
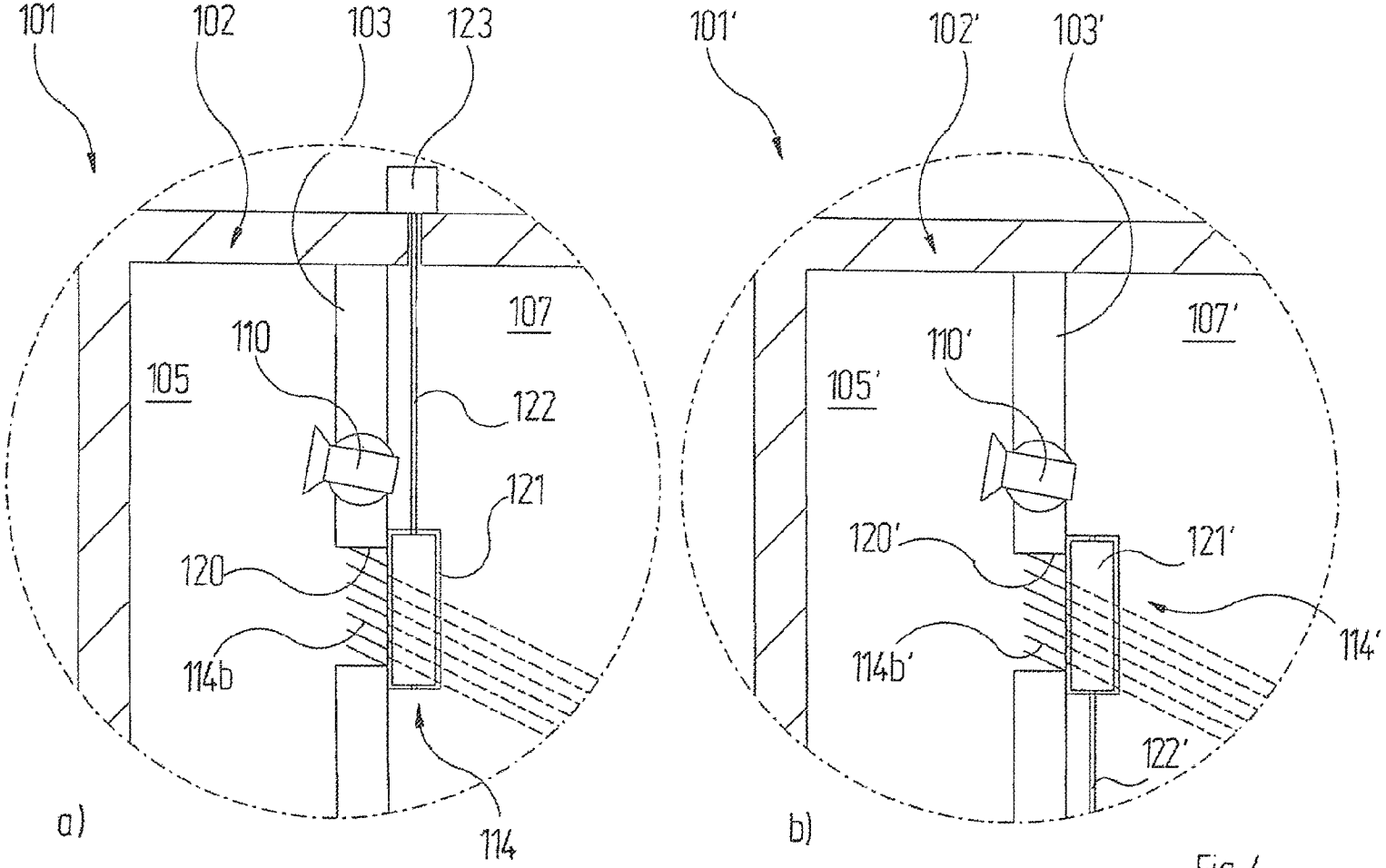
FIG. 4 shows vertical partial sections through two similar modifications of the drier shown in FIG. 1.

FIGS. 4*a* and 4*b* show schematically how the directions of projection of the nozzle units 114 of the exemplary embodiment of FIG. 3 can be changed. In the first exemplary embodiment shown in FIG. 4*a*, an aperture 120 is provided in the wall 103 beneath a "normal" nozzle 110, in which aperture a plurality of parallel, sloping fins 114*a* is rigidly fixed. The fins 114*a* specify the inclination of the air stream passing through the aperture 120, which is so chosen that the air stream, as shown in FIG. 1, is able to pass through a window of the motor vehicle body on the side of the body facing it and act upon the opposite body wall on the inside. In front of the aperture 120 on the side of the drying tunnel 107 there is provided a rotary body 121, which can be rotated by means of an electric motor 123 by way of an actuating rod 122, which extends vertically upwards and passes through the upper side of the housing 102. The rotary body 121 contains a plurality of parallel fins (not shown in the drawing), which extend vertically, and the air that has passed through the fins 114*a* in the aperture 120 is able to flow through the gaps between them. Obviously, it is thus possible, by rotating the rotary body 121 with the aid of the electric motor 123, to change the direction of projection of the nozzle units 114 in a manner shown in FIG. 3.

Figure 5:
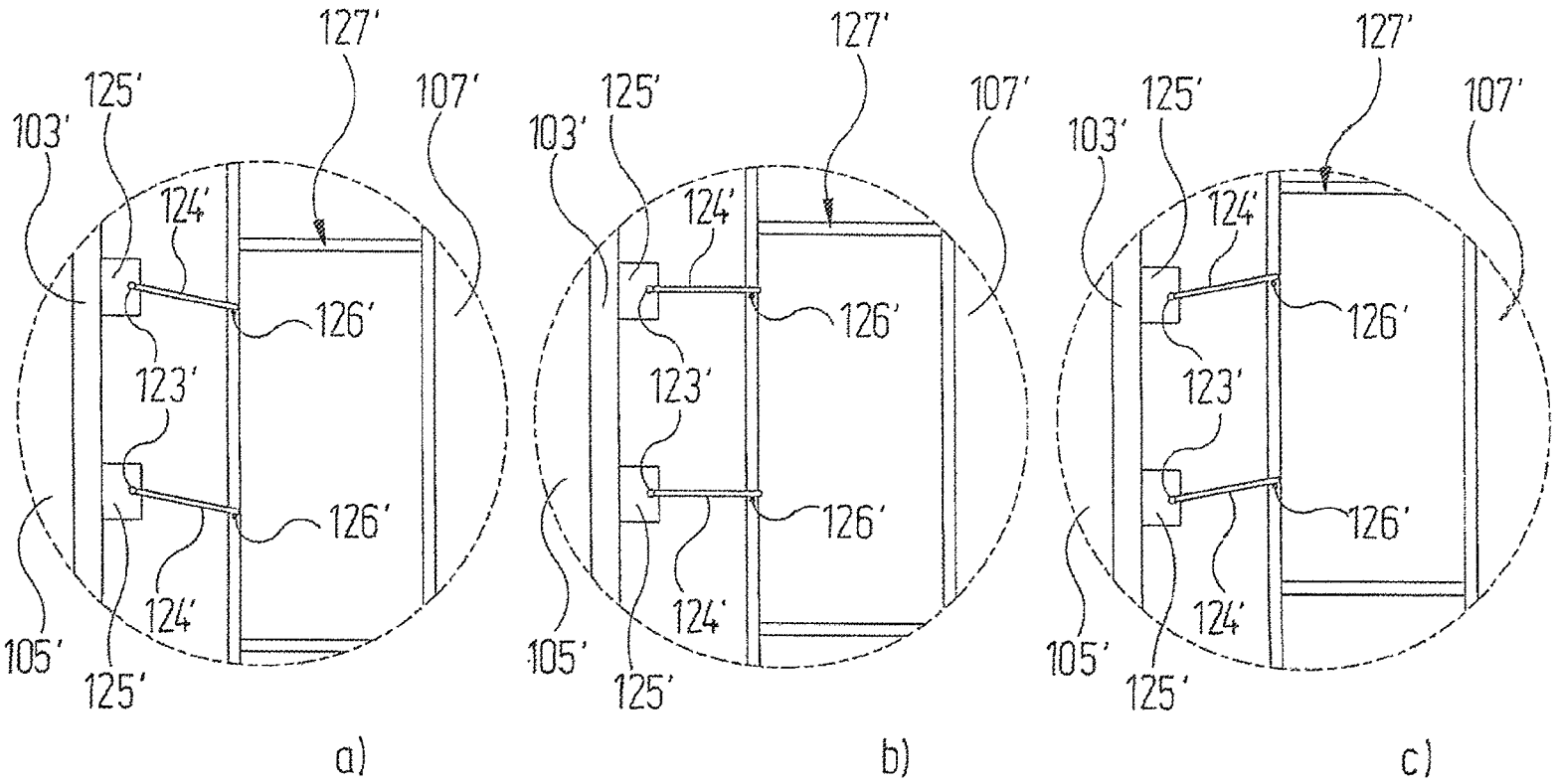
FIG. 5 shows a carrier mechanism for adjusting a nozzle unit in different positions.

The variant of the drier that is shown in FIG. 4*b* differs from that explained above by means of FIG. 4*a* only in the following: The actuating rod 122' connected to the rotary body 121' does not extend upwards but perpendicularly downwards, where it is connected not to an electric motor but to a carrier mechanism, which is shown in FIGS. 5*a* to 5*c*. The lower ends of the actuating rods 122 are rigidly connected to pivot levers 124 projecting into the interior of the drying tunnel 7 and are additionally mounted in bearing brackets 125 fixed to the wall 103. The free ends of the pivot levers 124 cooperate with pins 126, which are fixed to the upper side of the skids 127 on which the motor vehicle body is moved through the drying tunnel by means of the transport system. These motor vehicle bodies are not shown in FIG. 5.

In FIG. 5*a*, two pins 126 attached to a skid 127 have each reached the outer end of a pivot lever 124, which is associated with a nozzle unit 114, which from beneath. As the skid 127 travels further, the pivot levers 124 are pivoted about the bearing in the bearing brackets 125, as is shown in FIGS. 5*b* and 5*c*. 5*b* shows an intermediate position, while FIG. 5*c* shows a position of the skid 127 and the pivot levers 124 shortly before the time at which the ends of the pivot levers 124 come free of the pins 127. The pivot levers 124 are then returned by spring devices, which are located in the bearing brackets 125, to the position of FIG. 5*a* again, where they await the next skid 127 carrying a motor vehicle body. The exemplary embodiment of FIG. 4*b* with the carrier mechanism shown in FIG. 5 thus does not require a separate electric motor and the sensors and control devices necessary for the operation thereof.

Figure 6:
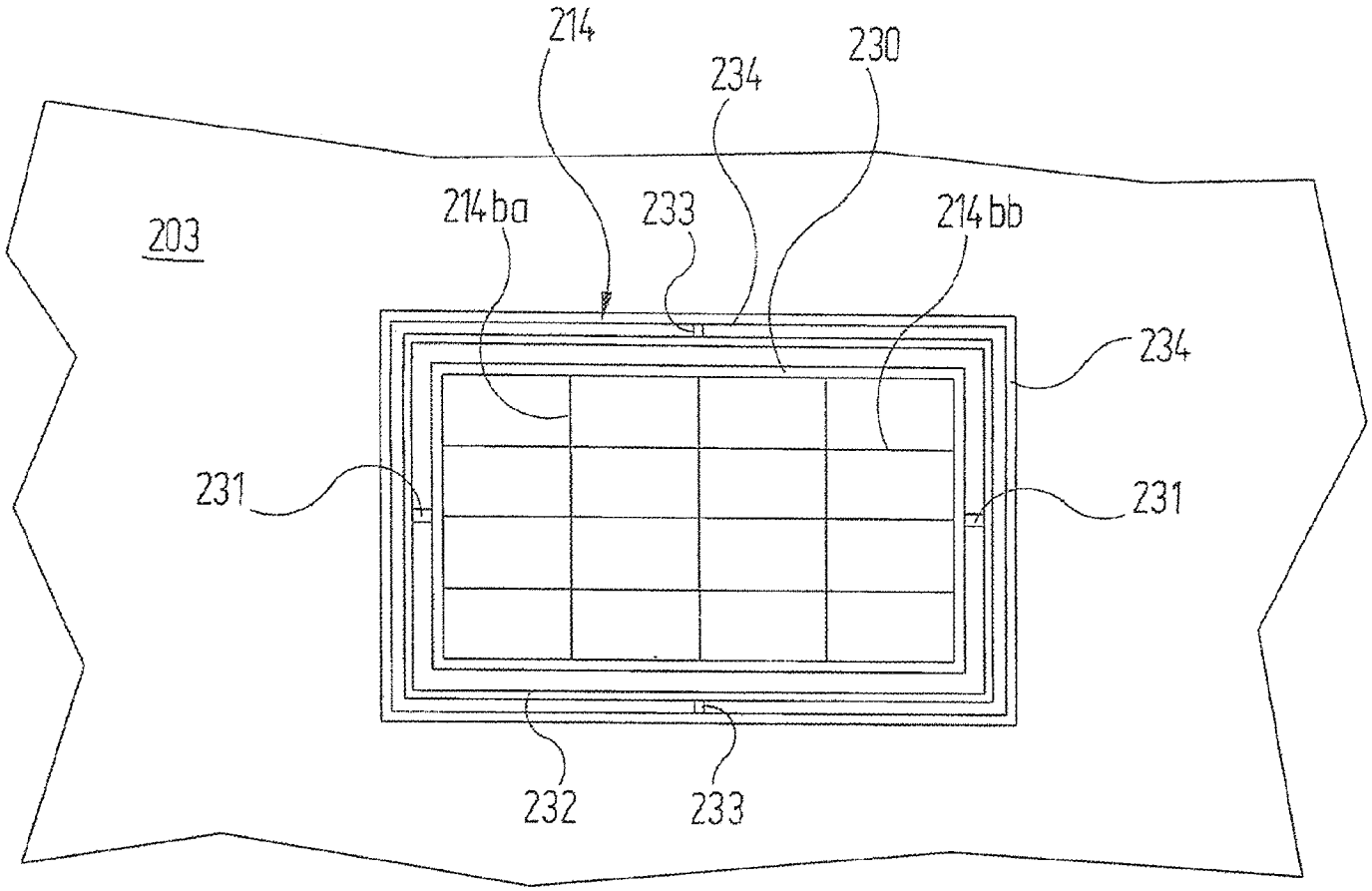
FIG. 6 shows a top view of a nozzle outlet in a further exemplary embodiment of a drier.
Figures 7, 8:
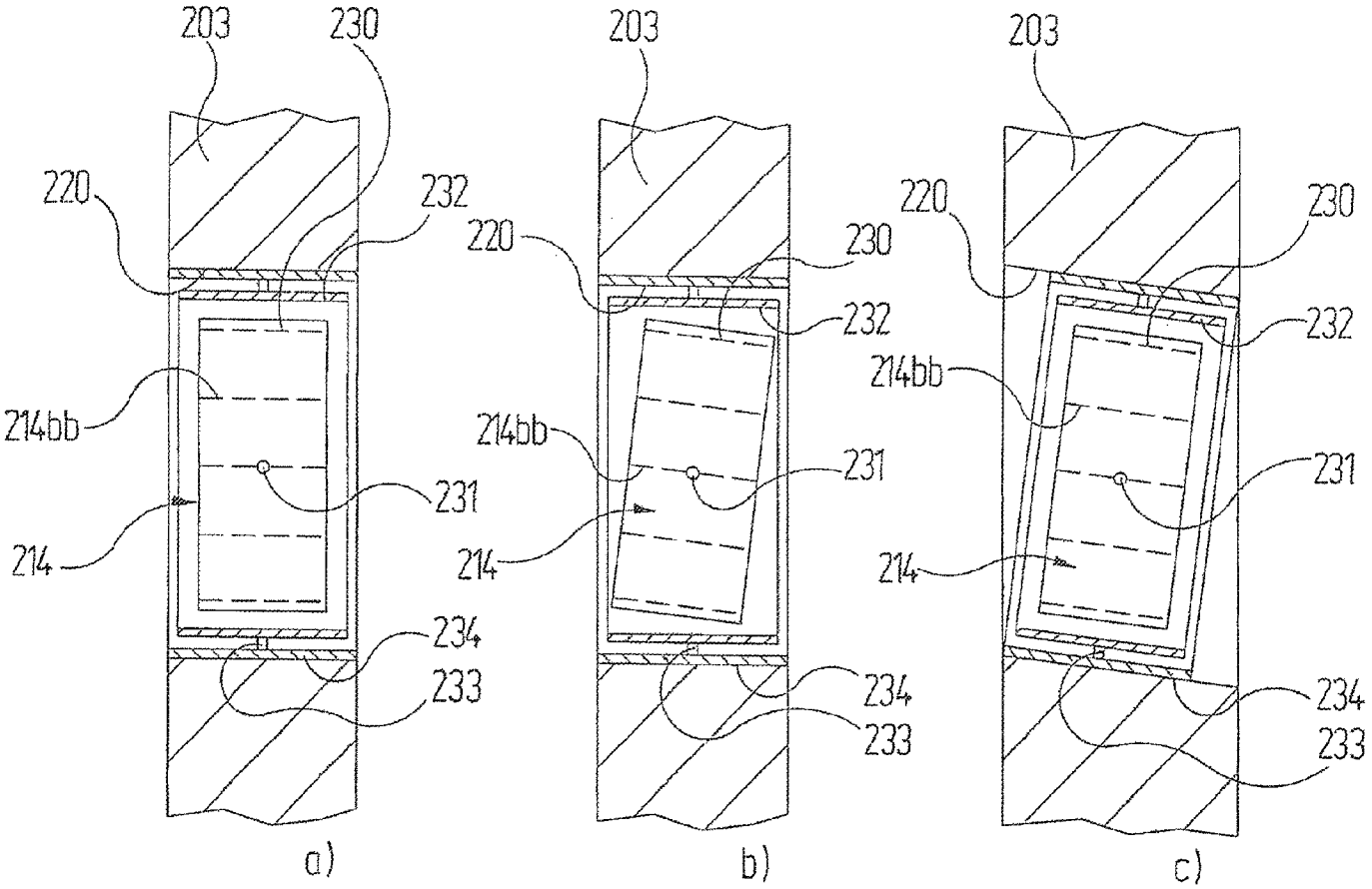
FIG. 7 shows vertical sections through an adjustable nozzle unit in two different positions.
FIG. 8 shows a vertical section, similar to FIG. 7, with an obliquely fitted nozzle unit.

In the exemplary embodiments of a drier according to the invention that have been described above by means of FIGS. 3 to 5, the direction of projection of the nozzle units 114, 115 was changed only by pivoting about a perpendicular axis, which left the inclination of the air stream flowing through the nozzle units 114, 115 relative to the horizontal unchanged. It is, of course, also possible, however, to provide nozzle units which permit rotation of the direction of projection about both the vertical and the horizontal axis. Such a nozzle unit is shown in FIGS. 6 and 7. Because it otherwise corresponds functionally to the nozzle unit 14 of FIG. 1, it bears the reference numeral 214 here.

FIG. 6 shows a top view of the outlet opening of the nozzle unit 214 fitted into the wall 203. It comprises an inner frame 230 in which there are fixed fins 214*ba* and 214*bb* that extend vertically and horizontally. The fins 214*ba*, 214*bb* can either cross over or be arranged one behind the other when viewed in the flow direction of the air. The inner frame 230 is mounted on gimbals. To that end, it is pivotably connected by way of two horizontally extending axle journals 231 to a central frame 232, which in turn is connected in an articulated manner by way of two vertically extending axle journals 233 to an outer frame 234. The outer frame 234 is in turn set into an aperture 220 of an appropriate size in the wall 203.

In FIG. 7, the aperture 220 extends perpendicularly through the wall 203, while in FIG. 8 the aperture 220' is inclined towards the drying tunnel, which is to be imagined on the right, so that the nozzle unit 214 in FIG. 8, while having the same construction, is able to reach a region of the motor vehicle body that is located further towards the bottom than in FIG. 7.

In FIG. 7, no drive mechanisms with which the frames 232 and 234 can be rotated about the respective axle journals 231, 233 are shown. The person skilled in the art naturally knows how motor-driven rotation of these frames 232, 234 can be carried out. In simple cases in which the direction of projection of the nozzle units 214 needs to be adjusted only rarely, the adjustment of the inner frame 230 relative to the outer frame 234 can also take place manually.

Figure 9:
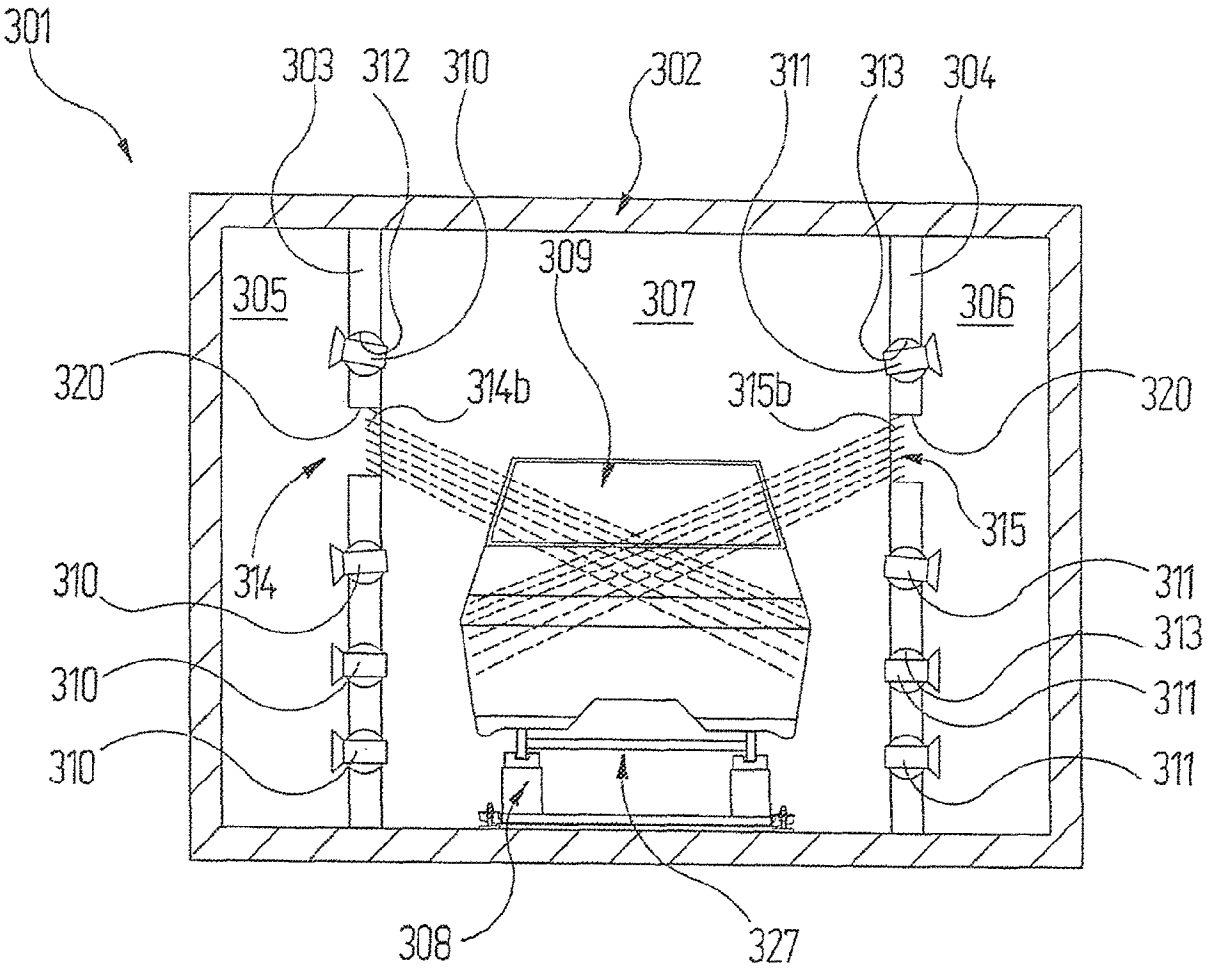
FIG. 9 shows a vertical section, similar to FIG. 1, through a further exemplary embodiment of a drier.

FIG. 9 shows a further exemplary embodiment of a drier, which corresponds to the greatest possible extent to that of FIG. 1. Corresponding parts in FIG. 9 are therefore identified with the same reference numerals as in FIG. 1 plus 300. The fundamental difference between the drier 1 of FIG. 1 and the drier 301 of FIG. 9 is that, in the former, the nozzle units 14 and 15 were removably mounted in the walls 3, 4 between the pressure chambers 5, 6 and the drying tunnel 7, while in the exemplary embodiment of FIG. 9 the nozzle units 314 are provided permanently in apertures 320 in the walls 303, 304. Otherwise, the functioning of the drier 301 is wholly identical with that of the drier 1.

Figure 10:
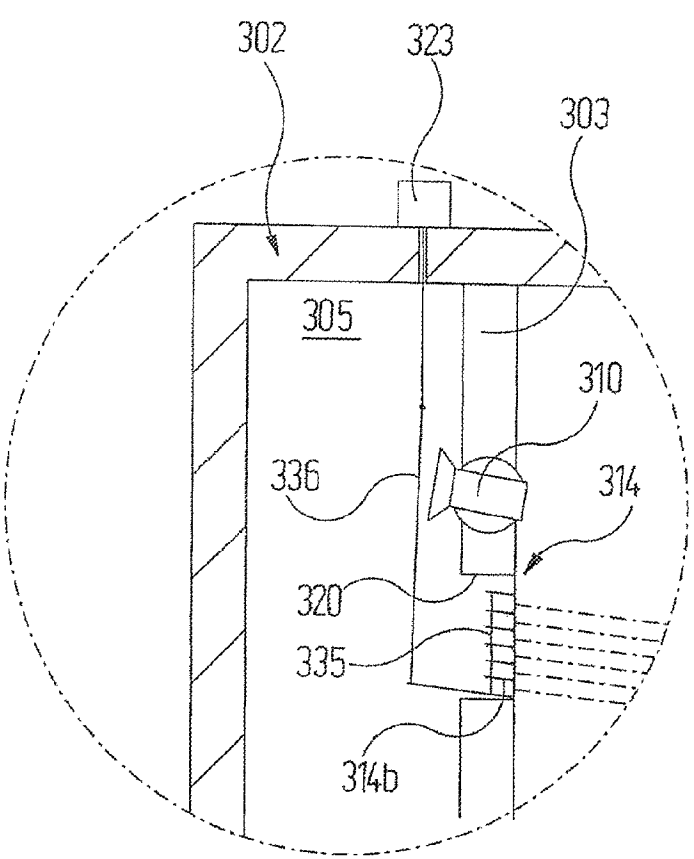
FIG. 10 shows vertical sections, similar to FIG. 4, through a drier having an adjustable nozzle unit in two nozzle positions.
Figure 10:
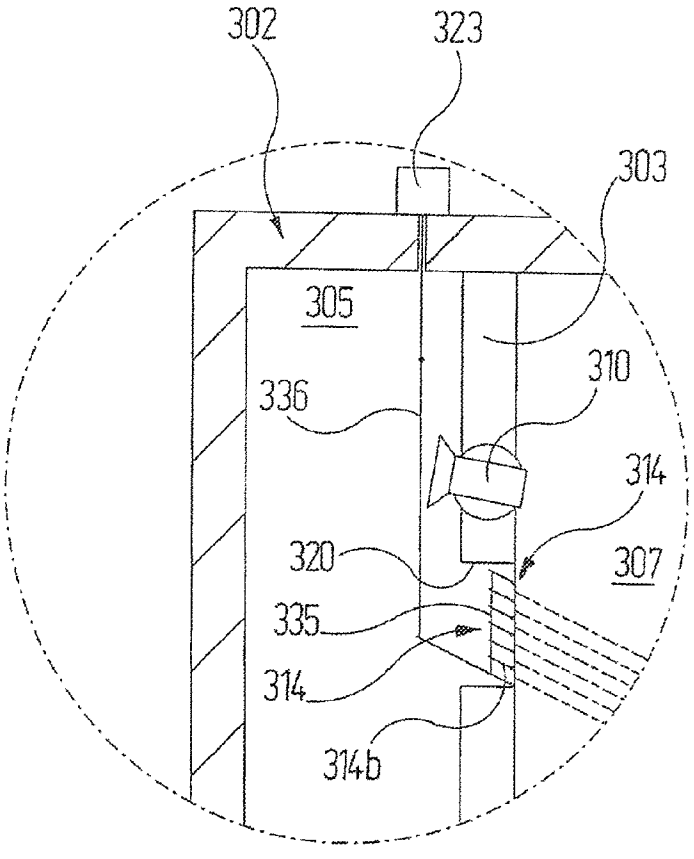

Finally, in FIG. 10, there is shown, by means of an exemplary embodiment of a drier similar to that of FIG. 9, the possibility of pivoting the direction of projection of the nozzles 214 solely about a horizontal axis. To that end, the fins 314*b*, which are located in the aperture 320, are pivotably articulated by their front edges with the side walls of the aperture 320, while their opposite edges are connected together in an articulated manner by a connecting rod 335 and with a pivot rod 336. This is guided through the upper side of the housing 302 of the drier 301 and connected to a drive 337. By axial movement of the pivot rod 336, it is possible, as will be understood by comparing FIGS. 10*a* and 10*b*, to change the orientation of the fins 314*b* in the aperture 320 and thus the direction of projection of the nozzle unit 314, which is formed by the aperture 320 and the fins 314*b* arranged therein.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A device for tempering motor vehicle bodies, the device comprising:

a) a housing;

b) a tempering tunnel accommodated in the housing for receiving a motor vehicle body;

c) at least one pressure chamber accommodated in the housing and separated from the tempering tunnel by a wall;

d) a plurality of nozzles in the wall;

e) an air tempering unit, which introduces tempered air into the pressure chamber such that the tempered air flows through the plurality of nozzles into the tempering tunnel and acts upon a motor vehicle body therein; and, f) at least one nozzle unit which is so oriented such that an air stream leaving the at least one nozzle unit passes through an opening in the motor vehicle body on a side facing the at least one nozzle unit and acts upon an inner surface of the motor vehicle body on an opposite side; wherein, g) the at least one nozzle unit includes, in a flow cross-section, movable air guiding elements inside the at least one nozzle unit, so that a direction of projection of the at least one nozzle unit is adjustable, h) at least one actuating rod is connected to the movable air guide elements and movement of the at least one actuating rod rotates the movable air guide elements inside the at least one nozzle to dynamically adjust air flow from the at least one nozzle unit to blow at a motor vehicle body in response to the motor vehicle body's position within the tempering tunnel; and i) at least one pivot lever, the pivot lever is connected to the at least one actuating rod, wherein a portion of the at least one pivot lever extends into the tempering tunnel to engage a skid carrying an automobile, wherein engagement of the portion of the at least one pivot lever causes the at least one actuating rod to rotate and move the movable air guide elements, changing the direction of air flow from the at least one nozzle unit.

2. The device according to claim 1, wherein the actuating rod is moved by at least one motor.

3. The device according to claim 1, wherein the movable air guiding elements are movable by a carrier device, which cooperates with a part that is moved together with the motor vehicle body in such a manner that the direction of projection of the nozzle unit follows the motor vehicle body over a certain distance as the motor vehicle body moves through the tempering tunnel.

4. The device according to claim 1, wherein the at least one nozzle unit includes air guiding elements that are pivotable about two mutually perpendicular axes.

5. The device of claim 1, wherein the at least one nozzle unit is removably fixed in at least one opening in the wall between the pressure chamber and the tempering tunnel.

6. The device of claim 5, wherein the at least one opening in which at least one nozzle unit is removably fixed is configured in the same manner as an openings in which the nozzles from the plurality of nozzles are fixed in the wall.

7. The device of claim 1, wherein each nozzle within the plurality of nozzles are adjustable with respect to their angular position.

8. The device of claim 7, wherein the at least one nozzle unit is fixed.

9. The device of claim 1 wherein the at least one nozzle unit includes, in a flow cross-section, movable air guiding elements, so that a direction of projection of the at least one nozzle unit is simultaneously adjustable about both a horizontal and a vertical axis.

10. The device of claim 1 further comprising at least one spring device connected to the at least one pivot lever, wherein the at least one spring device causes the at least one pivot lever to return to an initial position after the portion of the at least one pivot lever extending into the tempering tunnel disengages a skid carrying an automobile.

11. A device for tempering motor vehicle bodies, the device comprising:

a) a housing;

b) a tempering tunnel accommodated in the housing for receiving a motor vehicle body;

c) at least one pressure chamber accommodated in the housing and separated from the tempering tunnel by a wall;

d) a plurality of nozzles in the wall;

e) an air tempering unit, which introduces tempered air into the pressure chamber such that the tempered air flows through the plurality of nozzles into the tempering tunnel and acts upon a motor vehicle body therein; and, f) at least one nozzle unit which is so oriented such that an air stream leaving the at least one nozzle unit passes through an opening in the motor vehicle body on a side facing the at least one nozzle unit and acts upon an inner surface of the motor vehicle body on an opposite side; wherein, g) the at least one nozzle unit includes, in a flow cross-section, movable air guiding elements, so that a direction of projection of the at least one nozzle unit is adjustable, h) at least one actuating rod is connected to the movable air guide elements and movement of the at least one actuating rod rotates the movable air guide elements, and i) at least one pivot lever, the pivot lever being connected to the at least one actuating rod, wherein a portion of the at least one pivot lever extends into the tempering tunnel to engage a skid carrying an automobile, wherein engagement of the portion of the at least one pivot lever causes the at least one actuating rod to rotate and move the movable air guide elements, changing the direction of air flow from the at least one nozzle unit.

12. The device of claim 11 further comprising at least one spring device connected to the at least one pivot lever, wherein the at least one spring device causes the at least one pivot lever to return to an initial position after the portion of the at least one pivot lever extending into the tempering tunnel disengages a skid carrying an automobile.

13. The device according to claim 11, wherein the at least one actuating rod is moved by at least one motor.

14. The device according to claim 11, wherein the movable air guiding elements are movable by a carrier device, which cooperates with a part that is moved together with the motor vehicle body in such a manner that the direction of projection of the nozzle unit follows the motor vehicle body over a certain distance as the motor vehicle body moves through the tempering tunnel.

15. The device according to claim 11, wherein the at least one nozzle unit includes air guiding elements that are pivotable about two mutually perpendicular axes.

16. The device of claim 11, wherein the at least one nozzle unit is removably fixed in at least one opening in the wall between the pressure chamber and the tempering tunnel.

17. The device of claim 16, wherein the at least one opening in which at least one nozzle unit is removably fixed is configured in the same manner as an openings in which the nozzles from the plurality of nozzles are fixed in the wall.

18. The device of claim 11, wherein each nozzle within the plurality of nozzles are adjustable with respect to their angular position.

19. The device of claim 18, wherein the at least one nozzle unit is fixed.

20. The device of claim 11 wherein the at least one nozzle unit includes, in a flow cross-section, movable air guiding elements, so that a direction of projection of the at least one nozzle unit is simultaneously adjustable about both a horizontal and a vertical axis.

* * * * *